US009186781B2

(12) United States Patent
Wang

(10) Patent No.: US 9,186,781 B2
(45) Date of Patent: Nov. 17, 2015

(54) RATCHET SCREWDRIVER

(71) Applicant: Tzu-Chien Wang, Tainan (TW)

(72) Inventor: Tzu-Chien Wang, Tainan (TW)

( * ) Notice: Subject to any disclaimer, the term of this patent is extended or adjusted under 35 U.S.C. 154(b) by 266 days.

(21) Appl. No.: 14/017,310

(22) Filed: Sep. 4, 2013

(65) Prior Publication Data

US 2015/0059534 A1 Mar. 5, 2015

(51) Int. Cl.

*B25B 15/04* (2006.01)
*B25B 23/00* (2006.01)
*B25B 13/46* (2006.01)

(52) U.S. Cl.

CPC ..... *B25B 15/04* (2013.01); *B25B 13/463* (2013.01); *B25B 13/465* (2013.01); *B25B 23/0035* (2013.01); *B25B 23/0042* (2013.01)

(58) Field of Classification Search

CPC .... B25B 15/02; B25B 15/04; B25B 23/0007; B25B 23/0035; B25B 23/0042; B25B 13/465; B25B 13/463; B25B 1/085

USPC ..... 81/63.1, 62, 177.4

See application file for complete search history.

(56) References Cited

U.S. PATENT DOCUMENTS

| | | | | |
|---|---|---|---|---|
| 4,779,493 | A * | 10/1988 | White | 81/177.4 |
| 6,327,942 | B1 * | 12/2001 | Mariol et al. | 81/177.4 |
| 6,976,409 | B2 * | 12/2005 | Shu | 81/62 |
| 7,174,810 | B1 * | 2/2007 | Lin | 81/63.1 |
| 7,237,459 | B1 * | 7/2007 | Shiao | 81/62 |
| 8,210,074 | B2 * | 7/2012 | Wang | 81/63.2 |

* cited by examiner

*Primary Examiner* — Hadi Shakeri

(57) ABSTRACT

A ratchet screwdriver includes a handle receiving a rod coupled with a coupling sleeve. A spring is received in each of two recesses of the coupling sleeve and presses against one of two pawls abutting against abutment faces of the recesses. An output member has a ratchet portion mounted around the coupling sleeve and having ratchet teeth. The output device includes an output portion. Each spring biases one of the pawls. A switch ring mounted around the ratchet portion includes a pressing portion selectively pressing against and selectively disengaging one of the pawls from the ratchet teeth when the switch ring is rotated relative to the coupling sleeve to selectively engage a positioning device with one of positioning grooves in the switch ring.

1 Claim, 10 Drawing Sheets

B – B

A – A

RATCHET SCREWDRIVER

BACKGROUND OF THE INVENTION

The present invention relates to a ratchet screwdriver and, more particularly, to a ratchet screwdriver having a small size ratchet mechanism and providing enhanced operational convenience.

A conventional ratchet screwdriver can be coupled with a bit and can be adjusted to change the torque output direction to provide enhanced operational convenience. FIG. 8 shows a conventional ratchet screwdriver including a handle 1' and a ratchet mechanism 2' mounted to a front end of the handle 1'. The ratchet mechanism 2' includes a shank 21' at a front end thereof for coupling with a bit. A switch ring 22' is mounted around the handle 1' and can be rotated to adjust the torque output direction or free rotating direction of the shank 21'.

With reference to FIGS. 8 and 9, the handle 1' receives a rod 11 in a center portion thereof. A compartment 12' and a positioning member 13' are mounted in a front end of the handle 1'. The ratchet mechanism 2' has a diameter corresponding to that of the front end of the handle 1'. The ratchet mechanism 2' is mounted around the rod 11' and includes a ratchet gear 23' coupled to the shank 21' to move therewith. A catch 24' is mounted to each of a left side and a right side of the ratchet gear 23' and is biased by a spring 25'. The switch ring 22' includes two pressing portions 221' respectively pressing against the catches 24'. The switch ring 22' further includes three positioning grooves 222'. When the positioning member 13' is engaged in the middle positioning groove 222', both of the catches 24' engage with the ratchet wheel 23' such that the shank 21' can output a torque when rotated in either of the clockwise direction and the counterclockwise direction. When the positioning member 13' is engaged in the left positioning groove 222' or the right positioning groove 222', only one of the catches 24' engages with the left or the right positioning groove 222', such that the shank 21' can output a torque only when rotated in the clockwise or counterclockwise direction.

However, the compartment 12' must be large enough to receive the ratchet mechanism 2', resulting in a heavy ratchet screwdriver with a large front end. With reference to FIG. 10, to increase the use convenience, a plurality of bit holes 14' is defined in a bottom face of the handle 1' and windows 15' are defined in an outer periphery of the handle 1'. Bits 3' can be stored in the bit holes 14', allowing easy carriage. Furthermore, the bits 13' can be seen via the windows 15', and the bit 3' to be used can be moved out of the corresponding receptacle 14' by a finger extending through the corresponding window 15'. However, users having fat fingers can not excess the bits 3' via the windows 15' having a small width, which is inconvenient to use.

BRIEF SUMMARY OF THE INVENTION

An objective of the present invention is to provide a ratchet screwdriver having a small size ratchet mechanism and providing enhanced operational convenience.

A ratchet screwdriver according to the present invention includes a handle receiving a rod in a central portion thereof. A ratchet mechanism includes a coupling sleeve, two springs, two pawls, a positioning device, a coupling device, and an output member. The coupling sleeve includes a rear end coupled to the rod and a front end spaced from the rear end along a longitudinal axis of the handle. The coupling sleeve and the rod are jointly rotatable about the longitudinal axis of the handle. The coupling sleeve further includes two recesses in an outer periphery thereof. Each recess has an abutment face at a side thereof. The springs are respectively received in the recesses. Each pawl has a toothed outer side and an inner side with first and second ends. Each spring has an end pressing against the first end of the inner side of one of the pawls. The second end of the inner side of each pawl abuts against the abutment face of one of the recesses. The positioning device is mounted to the outer periphery of the coupling sleeve. The coupling sleeve is coupled to the output member by the coupling device. The output member includes a ratchet portion at a rear end thereof, with the ratchet portion being annular and mounted around the front end of the coupling sleeve. The output member further includes an output portion at a front end thereof, with the output portion adapted to couple with a bit. A space is formed between the ratchet portion and rear ends of the recesses. The ratchet portion includes ratchet teeth on an inner periphery thereof. Each spring biases the toothed outer side of one of the pawls to engage with the ratchet teeth. A switch ring is mounted around the ratchet portion of the output member. The switch ring includes a pressing portion received in a spacing between the pawls and in the space. The switch ring further includes a plurality of positioning grooves. The pressing portion selectively presses against and selectively disengages one of the pawls from the ratchet teeth of the output member when the switch ring is rotated relative to the coupling sleeve to selectively engage the positioning device with one of the plurality of positioning grooves to adjust a torque output direction of the coupling sleeve.

Preferably, the handle further includes a plurality of bit holes surrounding the rod, with each bit hole extending from a front end through a rear end of the handle along the longitudinal axis. At least one bit is removably received in the plurality of bit holes.

Preferably, the rod has polygonal cross sections, and the rear end of the coupling sleeve includes a coupling groove having polygonal cross sections. The rod is coupled in the coupling sleeve to allow joint rotation of the coupling sleeve and the rod.

Preferably, each recess includes a receptacle. The receptacle of each recess receives the other end of one of the springs. Each spring presses against an end wall of one of the receptacles.

Preferably, a hole is defined in the outer periphery of the coupling sleeve. The positioning device includes a retaining spring and a ball received in the hole. The ball is biased by the retaining spring into one of the plurality of positioning grooves.

Preferably, the output member further includes a flange formed around the ratchet portion. The flange abuts a front end of the switch ring. Each of the front end of the coupling sleeve and the output member further includes an engagement groove. The coupling device includes two rear rings and a C-shaped front retainer ring. The rear rings are mounted around the rear end of the coupling sleeve and abut a rear end of the switch ring. The C-shaped front retainer ring engages in the engagement grooves of the coupling sleeve and the output member to couple the coupling groove to the output member.

Preferably, the ratchet portion includes an inner periphery having a shoulder. The front end of the coupling sleeve abuts the shoulder of the ratchet portion. Each recess is not completely enclosed by the ratchet portion to form the space between the ratchet portion and the rear ends of the two recesses.

The present invention will become clearer in light of the following detailed description of illustrative embodiments of this invention described in connection with the drawings.

DETAILED DESCRIPTION OF THE INVENTION

Figure 1:
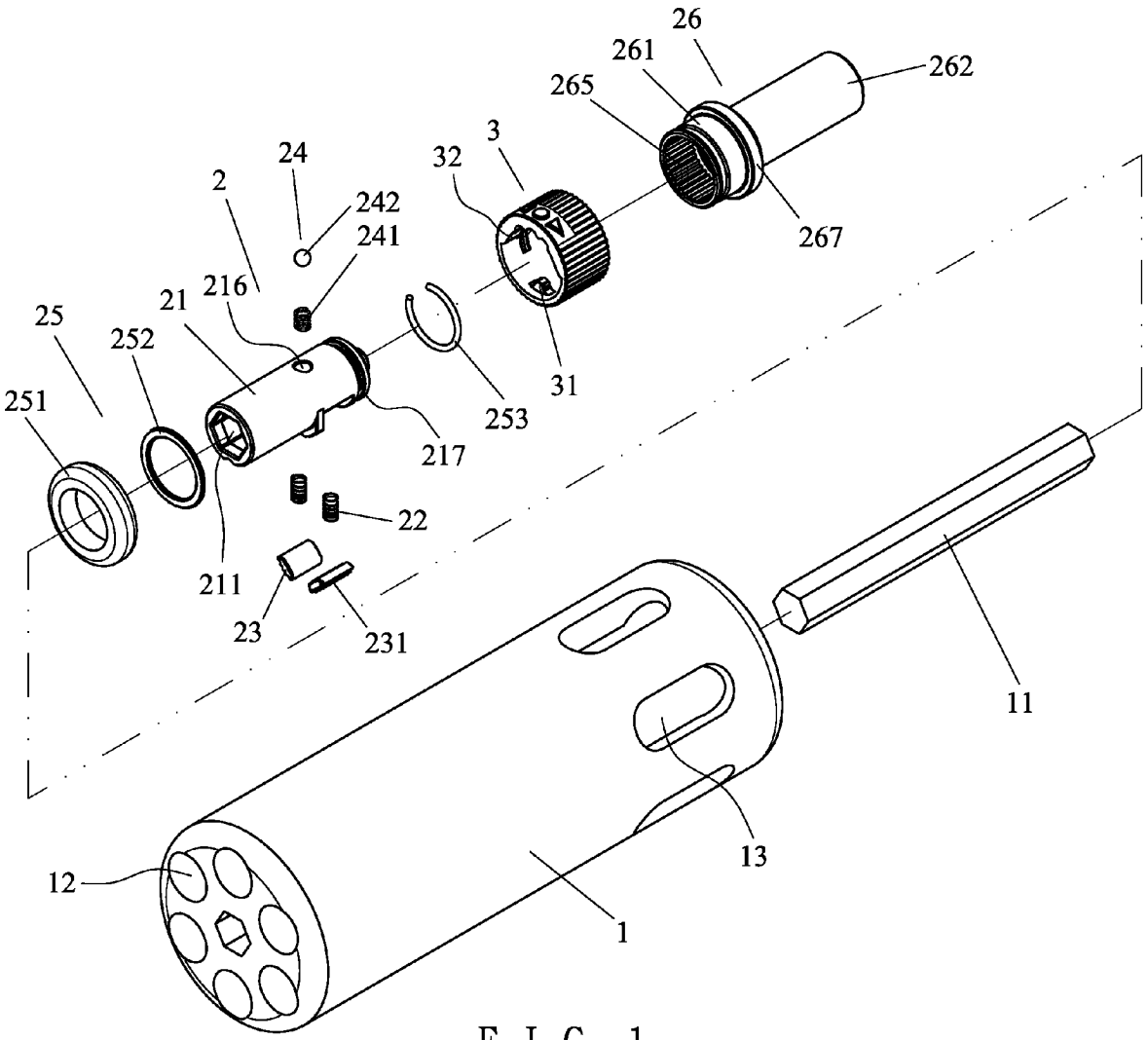
FIG. 1 is an exploded, perspective view of a ratchet screwdriver according to the present invention.
Figure 2:
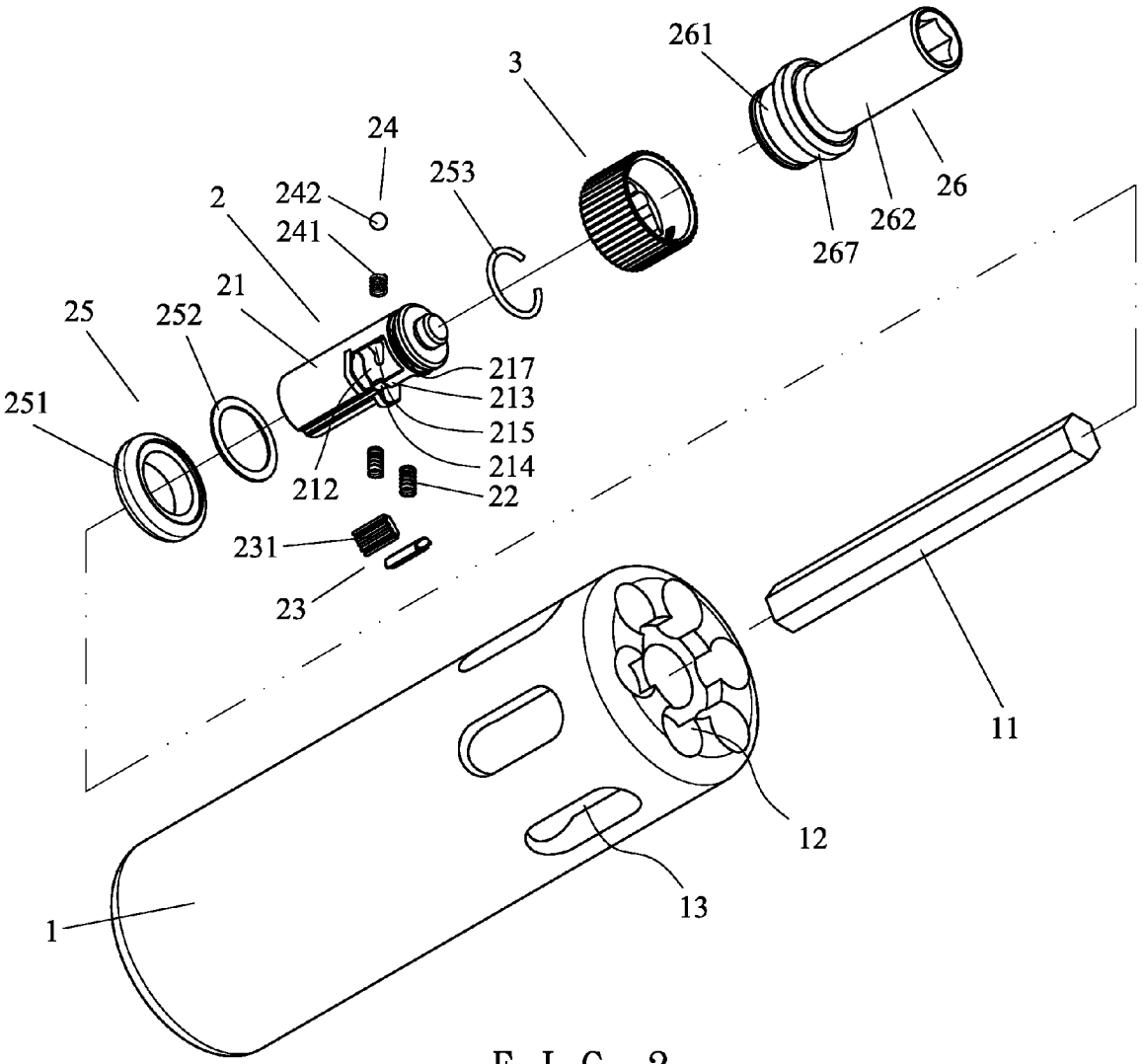
FIG. 2 is another exploded, perspective view of the ratchet screwdriver of FIG. 1.
Figure 3:
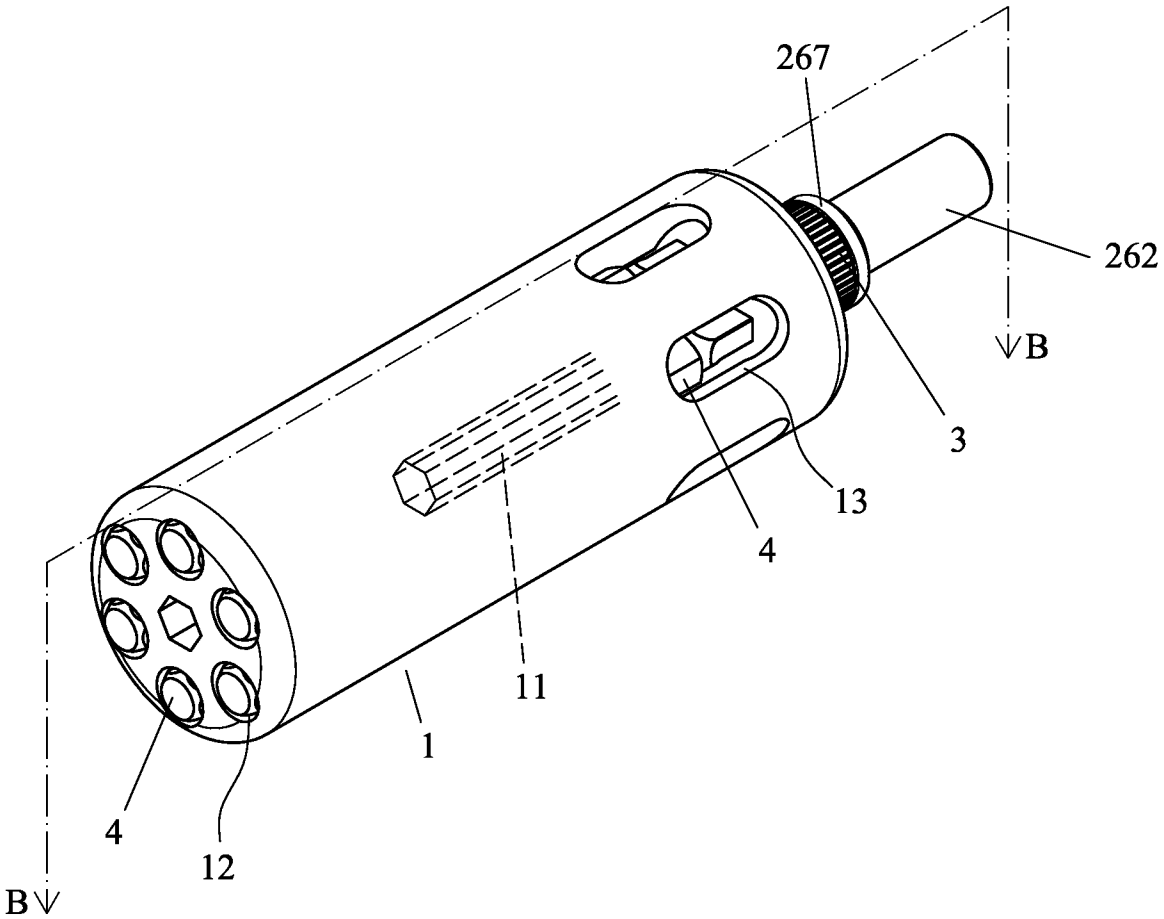
FIG. 3 is a perspective view of the ratchet screwdriver of FIG. 1.

With reference to FIGS. 1-5, a ratchet screwdriver according to the present invention includes a handle 1, a ratchet mechanism 2, and a switch ring 3. The handle 1 receives a rod 11 in a central portion thereof. The rod 11 has polygonal cross sections. The handle 1 further includes a plurality of bit holes 12 surrounding the rod 11, with each bit hole 12 extending from a front end through a rear end of the handle 1 along a longitudinal axis of the handle 1. A bit 4 is removably received in each bit hole 12. The handle 1 further includes a plurality of windows 13, with each window 13 extending from an outer periphery of the handle 1 through one of the bit holes 12 to allow a user to view the bit 4 in the bit hole 12.

The ratchet mechanism 2 includes a coupling sleeve 21, two springs 22, two pawls 23, a positioning device 24, a coupling device 25, and an output member 26. A rear end of the coupling sleeve 21 includes a coupling groove 211 having polygonal cross sections. The rod 11 is coupled in the coupling sleeve 21 to allow joint rotation of the coupling sleeve 21 and the rod 11 about a longitudinal axis of the handle 1. The coupling sleeve 21 further has a front end spaced from the rear end along the longitudinal axis of the handle 1. The coupling sleeve 21 further includes two recesses 212 in the outer periphery thereof. Each recess 212 has an abutment face 213 at a side thereof. A notch 214 is defined behind the recesses 212 and is in communication with the recesses 212. Each recess 212 includes a receptacle 215 receiving an end of one of the springs 22, with the end of the spring 22 pressing against an end wall of the receptacle 215. Each pawl 23 has a toothed outer side 231 and an inner side with first and second ends. The other end of each spring 22 presses against the first end of the inner side of one of the pawls 23. The second end of the inner side of each pawl 23 abuts against the abutment face 213 of one of the recesses 212. The positioning device 24 is mounted to the outer periphery of the coupling sleeve 21. In this embodiment, a hole 216 is defined in the outer periphery of the coupling sleeve 21, and the positioning device 24 includes a retaining spring 241 and a ball 242 received in the hole 216. The ball 242 is biased by the retaining spring 241 to partially protrude out of the hole 216. The coupling sleeve 211 further includes an engagement groove 217 in the outer periphery at the front end thereof.

The coupling sleeve 21 is coupled to the output member 26 by the coupling device 25. In this embodiment, the coupling device 25 includes two rear rings 251 and 252 and a C-shaped front retainer ring 253. The rear rings 251 and 252 are mounted around the rear end of the coupling sleeve 21 and abut a rear end of the switch ring 3.

Figure 4:
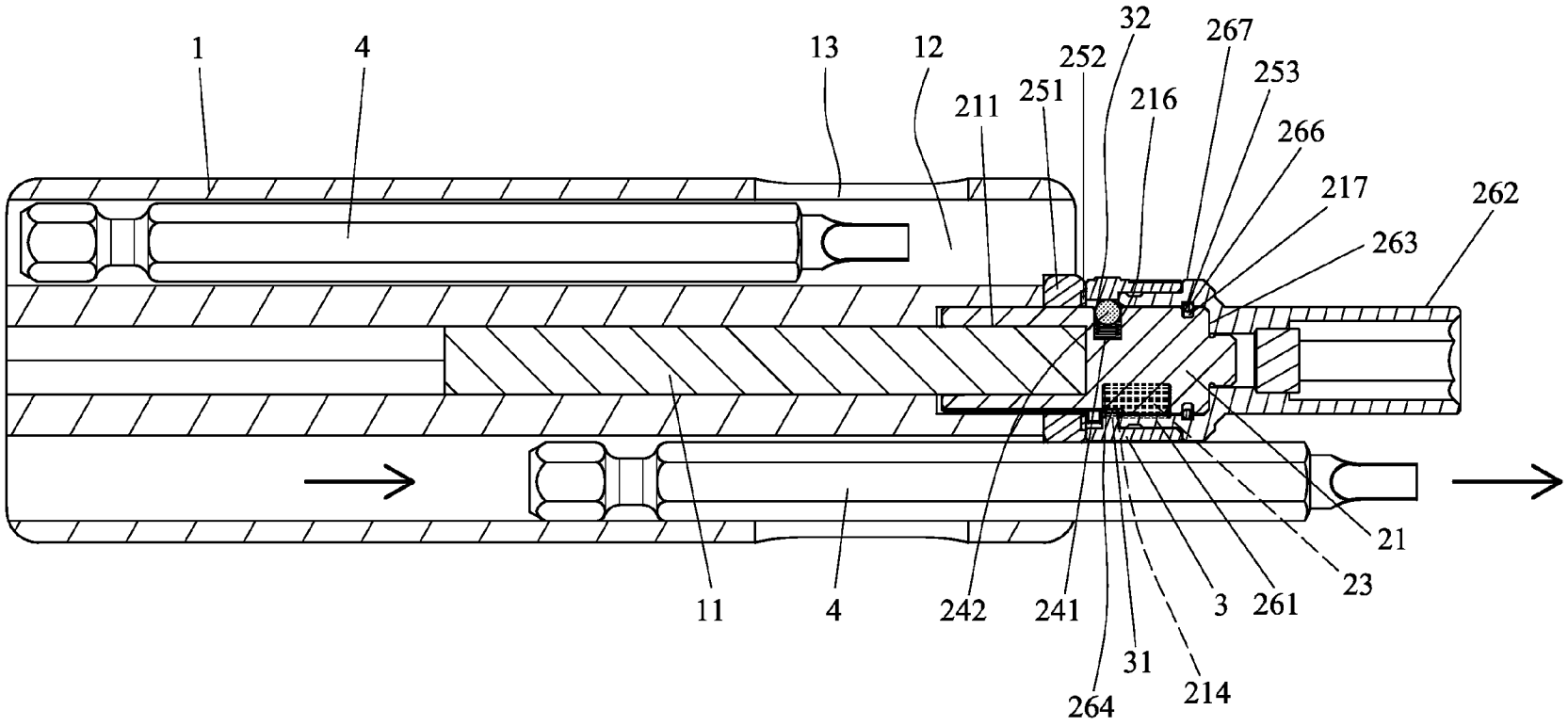
FIG. 4 is a cross sectional view taken along section line B-B of FIG. 3.

The output member 26 includes a ratchet portion 261 at a rear end thereof. The ratchet portion 261 is annular and mounted around the front end of the coupling sleeve 21. The output member 26 further includes an output portion 262 at a front end thereof. The output portion 262 is adapted to couple with a bit 4. The ratchet portion 261 includes an inner periphery having a shoulder 263. The front end of the coupling sleeve 21 abuts the shoulder 263 of the ratchet portion 261, with each recess 212 not completely enclosed by the ratchet portion 261 to form a space 264 between the ratchet portion 261 and the rear ends of the recesses 212 (FIG. 4). The ratchet portion 261 further includes ratchet teeth 265 on the inner periphery thereof. Each spring 22 biases the toothed outer side 231 of one of the pawls 23 to engage with the ratchet teeth 265. The ratchet portion 261 of the output member 26 further includes an engagement groove 266 in the inner periphery thereof. The C-shaped front retainer ring 253 is engaged in the engagement grooves 217 and 266 of the coupling sleeve 21 and the output member 26 to couple the coupling groove 21 to the output member 26. A flange 267 is formed around the ratchet portion 261.

The switch ring 3 is mounted around the ratchet portion 261 of the output member 26, with a front end of the switch ring 3 abutting the flange 267, and with the rear rings 251 and 252 abutting the rear end of the switch ring 3 to retain the switch ring 3 in a desired longitudinal position. The switch ring 3 further includes a pressing portion 31 received in a spacing between the pawls 23 and in the space 264. The switch ring 3 further includes first, second, and third positioning grooves 32, with the second positioning groove 32 located between the first and third positioning grooves 32 in a circumferential direction about the longitudinal axis. The pressing portion 31 selectively presses against and selectively disengage one of the pawls 23 from the ratchet teeth 265 of the output member 26 when the switch ring 3 is rotated relative to the coupling sleeve 21 to selectively engage the positioning device 24 in one of the first, second, and third positioning grooves 32 to adjust a torque output direction of the coupling sleeve 21. Note that the ball 242 is biased by the retaining spring 241 into one of the first, second, and third positioning grooves 32.

Figure 5:
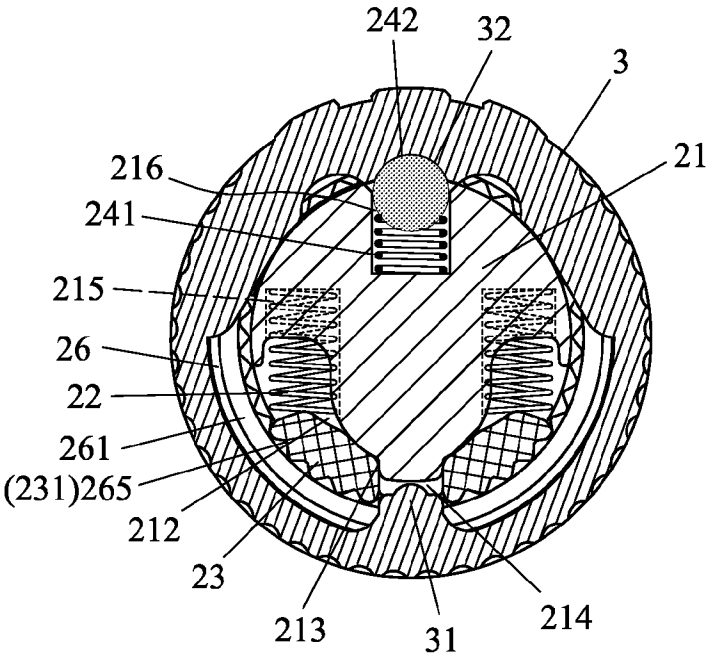
FIG. 5 is another cross sectional view of the ratchet screwdriver of FIG. 1, with the screwdriver outputting a torque when driven in either of a clockwise direction and a counterclockwise direction.

With reference to FIGS. 4 and 5, when the switch ring 3 is in a position in which the ball 242 engages with the second positioning groove 32, the pressing portion 31 is sandwiched between the pawls 23. Both pawls 23 engage with the ratchet teeth 265 of the output member 26. Thus, the output member 26 outputs a torque when the handle 1 is rotated in either of the clockwise and counterclockwise directions.

Figure 6:
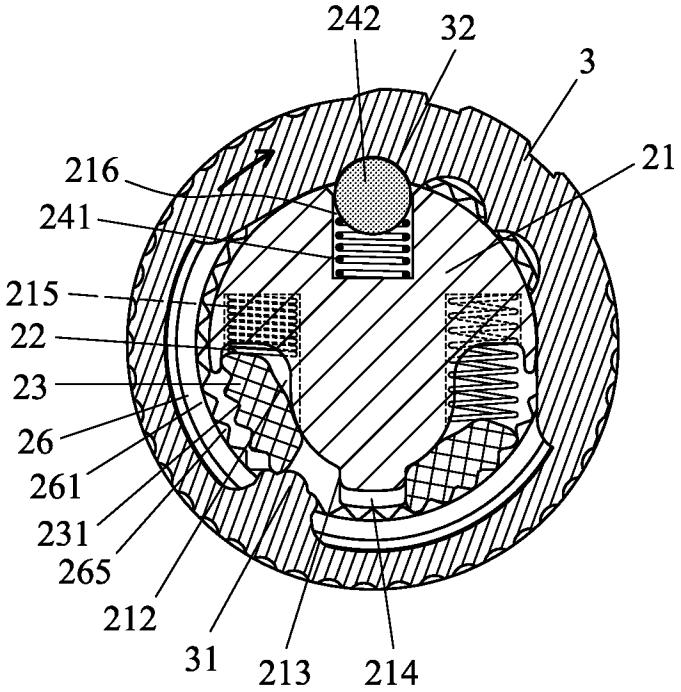
FIG. 6 is a cross sectional view similar to FIG. 5, with the screwdriver outputting a torque when driven in the clockwise direction.

With reference to FIGS. 4 and 6, when the switch ring 3 is rotated through an angle in the clockwise direction, the pressing portion 31 moves in the notch 214 and presses against one of the pawls 23 (the left one in FIG. 6), disengaging the left pawl 23 from the ratchet teeth 265 of the output member 26. Furthermore, the ball 242 engages with the first positioning groove 32. When the handle 11 rotates jointly with the coupling sleeve 21 in the clockwise direction by rotating the handle 11, a torque is outputted because the other pawl 23 (the right one in FIG. 6) presses against the corresponding abutment face 213. If the coupling sleeve 21 rotates in the counterclockwise direction, movement of the right pawl 23 compresses the corresponding spring 22, causing free rotation without outputting a torque.

Figure 7:
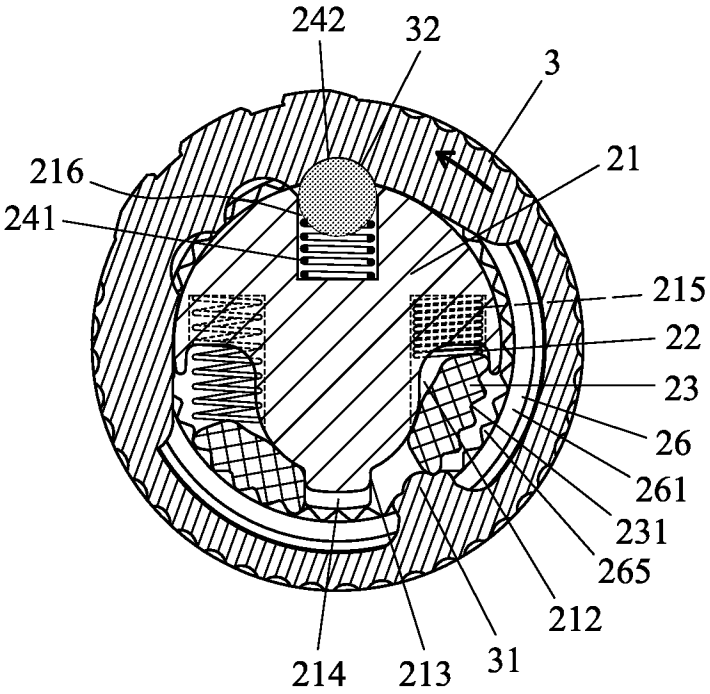
FIG. 7 is a cross sectional view similar to FIG. 5, with the screwdriver outputting a torque when driven in the counterclockwise direction.
Figure 8:
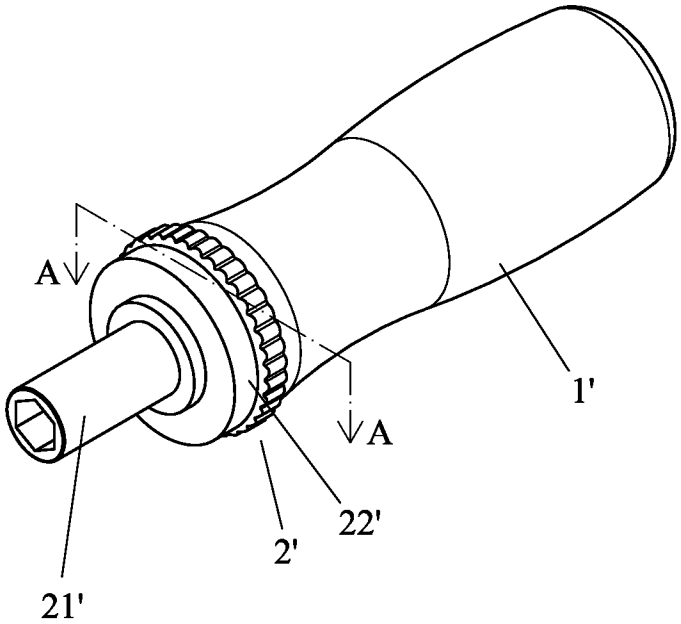
FIG. 8 PRIOR ART
FIG. 8 is a perspective view of a conventional ratchet screwdriver.
Figure 9:
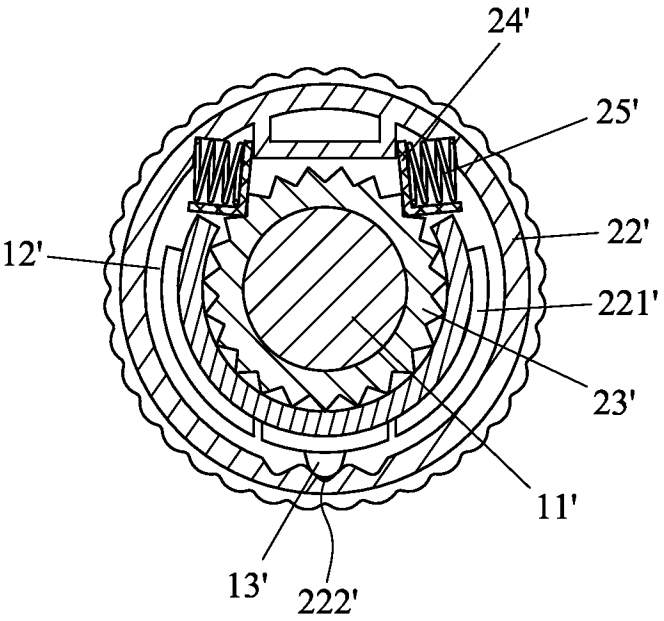
FIG.9 PRIOR ART
FIG. 9 is a cross sectional view taken along section line A-A of FIG. 8.
Figure 10:
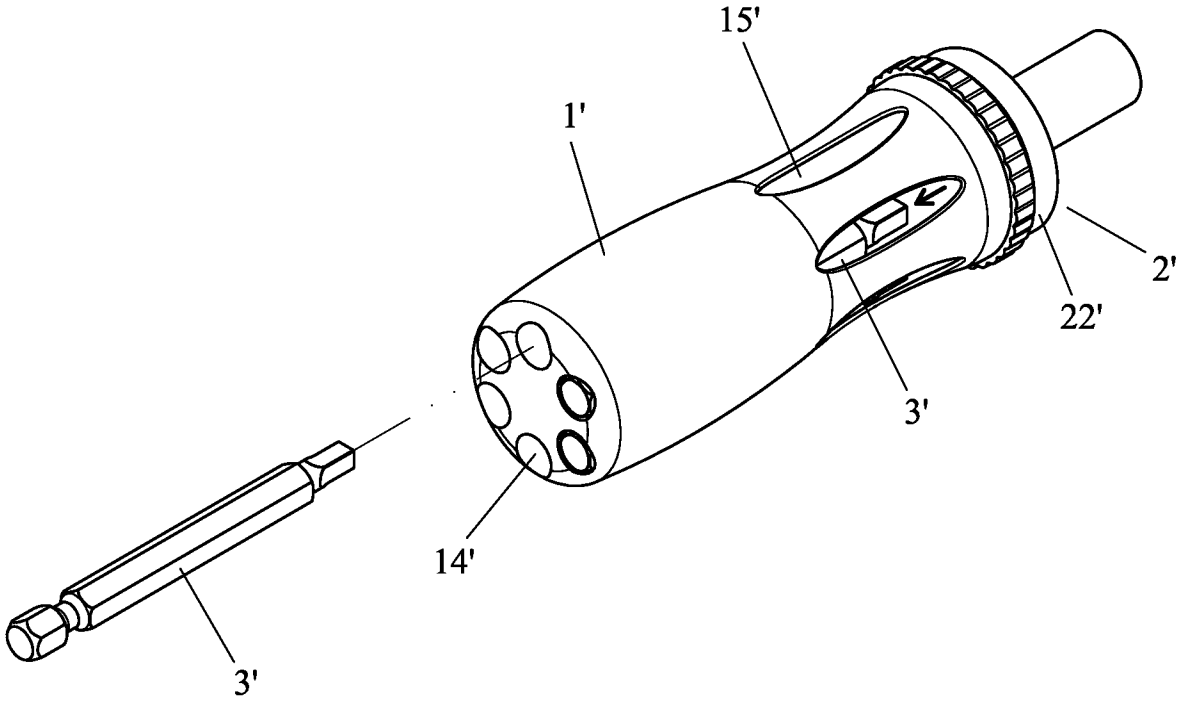
FIG.10 PRIOR ART
FIG. 10 is an exploded, perspective view of another conventional ratchet screwdriver.

With reference to FIGS. 4 and 7, on the other hand when the switch ring 3 is rotated through an angle in the counterclockwise direction, the pressing portion 31 moves in the notch 214 and presses against the right pawl 23, disengaging the right pawl 23 from the ratchet teeth 265 of the output member 26. Furthermore, the ball 242 engages with the third positioning groove 32. When the handle 11 rotates jointly with the coupling sleeve 21 in the counterclockwise direction by rotating the handle 11, a torque is outputted because the left pawl 23 presses against the corresponding abutment face 213. If the coupling sleeve 21 rotates in the clockwise direction, movement of the left pawl 23 compresses the corresponding spring 22, causing free rotation without outputting a torque.

Since the coupling sleeve 21 includes the recesses 212 receiving the pawls 23 and the springs 22, the overall diameter of the ratchet mechanism 2 and the switch ring 3 is only slightly larger than a diameter of the rod 11 and is far less than a diameter of the bottom end of the handle 1, reducing the weight of the front end of the handle 1 to increase operational convenience. Furthermore, the bit holes 12 can be formed in the handle 1, because the ratchet mechanism 2 and the switch ring 3 occupy a small space. Further, each bit 4 can be pushed by the rear end thereof through a corresponding bit hole 12 such that a user can remove the bit 4 via the front end of the corresponding bit hole 12, providing easy retrieval of the bit 4.

Although specific embodiments have been illustrated and described, numerous modifications and variations are still possible without departing from the scope of the invention. The scope of the invention is limited by the accompanying claims.

The invention claimed is:

1. A ratchet screwdriver comprising: a handle receiving a rod in a central portion thereof; a ratchet mechanism including a coupling sleeve, two springs, two pawls, a positioning device, a coupling device, and an output member, with the coupling sleeve including a rear end coupled to the rod and a front end spaced from the rear end along a longitudinal axis of the handle, with the coupling sleeve and the rod jointly rotatable about the longitudinal axis of the handle, with the coupling sleeve further including two recesses in an outer periphery thereof, with each of the two recesses having an abutment face at a side thereof, with the two springs respectively received in the two recesses, with each of the two pawls having a toothed outer side and an inner side with first and second ends, with each of the two springs having an end pressing against the first end of the inner side of one of the two pawls, with the second end of the inner side of each of the two pawls abutting against the abutment face of one of the two recesses, with the positioning device mounted to the outer periphery of the coupling sleeve, with the coupling sleeve coupled to the output member by the coupling device, with the output member including a ratchet portion at a rear end thereof, with the ratchet portion being annular and mounted around the front end of the coupling sleeve, with the output member further including an output portion at a front end thereof, with the output portion adapted to couple with a bit, with a space formed between the ratchet portion and rear ends of the two recesses, with the ratchet portion including ratchet teeth on an inner periphery thereof, with each of the two springs biasing the toothed outer side of one of the two pawls to engage with the ratchet teeth; and a switch ring mounted around the ratchet portion of the output member, with the switch ring including a pressing portion received in a spacing between the two pawls and in the space, with the switch ring further including a plurality of positioning grooves, with the pressing portion selectively pressing against and selectively disengaging one of the two pawls from the ratchet teeth of the output member when the switch ring is rotated relative to the coupling sleeve to selectively engage the positioning device with one of the plurality of positioning grooves to adjust a torque output direction of the coupling sleeve, with the output member further including a flange formed around the ratchet portion, with the flange abutting a front end of the switch ring, with each of the front end of the coupling sleeve and the output member further including an engagement groove, with the coupling device including two rear rings and a C-shaped front retainer ring, with the two rear rings mounted around the rear end of the coupling sleeve and abutting a rear end of the switch ring, with the C-shaped front retainer ring engaged in the engagement grooves of the coupling sleeve and the output member to couple the coupling groove to the output member.

* * * * *